United States Patent [19]

Stoltman, Jr. et al.

[11] 4,090,449

[45] May 23, 1978

[54] METHOD FOR SYNCHRONIZING POINT DETONATING ARMING WITH CONTROLLED VARIABLE TIME DETONATING ARMING IN MILITARY FUZES

[75] Inventors: Stephen Stoltman, Jr.; Charles W. Tepper, both of Rochester, N.Y.

[73] Assignee: The United States of America as represented by the Secretary of the Navy, Washington, D.C.

[21] Appl. No.: 8,160

[22] Filed: Jan. 19, 1970

[51] Int. Cl.[2] ..... F42B 9/08

[52] U.S. Cl. ..... 102/70.2 P

[58] Field of Search ..... 102/70.2 P, 71, 78; 62/70.2 R

[56] References Cited

U.S. PATENT DOCUMENTS

| | | | |
|---|---|---|---|
| 2,509,910 | 5/1950 | Dike | 102/70.2 P |
| 3,060,857 | 10/1962 | Smith | 102/70.2 P |

*Primary Examiner*—Samuel Feinberg

*Attorney, Agent, or Firm*—R. Sciascia; R. Beers; S. Sheinbein

[57] ABSTRACT

A fuze utilizing both point detonation and controlled variable time detonation that arms the point detonation apparatus at the same time the controlled variable time detonation apparatus is armed. Addition of a commutator and associate wiper in the controlled variable time arming circuit of a controlled variable time fuze, and placement of the point detonation arming switch across the firing capacitor and electric primer, prevents point detonation until controlled variable time arming occurs.

10 Claims, 1 Drawing Figure

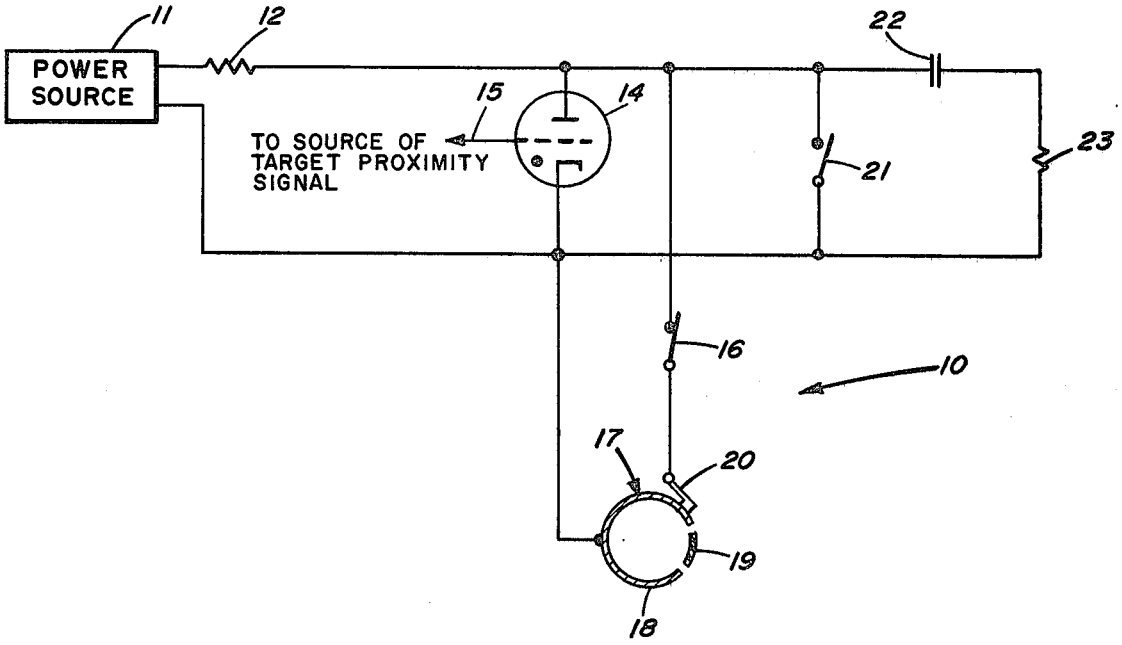
POWER SOURCE
11
12
22
15
14
TO SOURCE OF TARGET PROXIMITY SIGNAL
21
23
16
10
17
20
19
18

METHOD FOR SYNCHRONIZING POINT DETONATING ARMING WITH CONTROLLED VARIABLE TIME DETONATING ARMING IN MILITARY FUZES

STATEMENT OF GOVERNMENT INTEREST

The invention described herein may be manufactured and used by or for the Government of the U.S. of America for governmental purposes without the payment of any royalties thereon or therefor.

BACKGROUND OF THE INVENTION

This invention pertains to controlled variable time fuzes and more specifically to the improvement of military controlled variable time fuzes by synchronizing arming of point detonation apparatus with arming of controlled variable time detonation apparatus. Certain fuzes in use with military weapon systems for detonating an explosively loaded projectile are designed so that they can be set by the firing crew to function exclusively on impact with a target, referred to as point detonation (PD), or on proximity to the target, referred to as controlled variable time detonation (CVTD). At the latter setting, the PD feature is active as a back-up to the CVTD feature.

When these prior art fuzes are set to operate in the CVTD mode, the time after launching at which the CVTD circuit arms is selected to obtain various tactical advantages such as safe operation when in proximity to friendly terrain. When so set, the PD circuit arms almost immediately after launching. So detonation will occur upon accidental impact with friendly terrain.

The present invention, however, provides that when the fuze is set to function in the CVTD mode, PD arming is withheld until the time selected for CVTD arming. The advantage of this arrangement is that the projectile cannot detonate, by normal fuzing action, upon accidental impact occuring before the selected time after launch. The present invention further does not preclude the fuze from being set exclusively in the PD mode.

SUMMARY OF THE INVENTION

The power source, electronic switch, charging resistor, firing capacitor, PD switch and CVTD arming switch of a normal or conventional CVTD fuze is utilized with the addition of a commutator and its associated wiper arranged in such a manner so that PD arming is withheld until the time after launching selected for CVTD arming. The capability to set the fuze to function exclusively in the PD mode is not impaired.

When the fuze is set to operate in the CVTD mode, the wiper of the commutator is in electrical contact with the conductive portion of the commutator ring at all CVTD time setting positions. The firing capacitor cannot be charged by the power source and cannot detonate the electric primer until the CVTD arming switch opens at the set time after launching. Thereafter the firing capacitor will charge and will detonate the electric primer if either the electronic switch is closed by a target proximity signal or if the PD switch is closed by target inpact.

When the fuze is set to operate exclusively in the PD mode, the wiper bears on the insulated portion of the commutator ring. The firing capacitor will be charged irrespective of the position of the CVTD arming switch. Thereafter the electric primer will be detonated if the PD switch is closed upon target impact.

OBJECTS OF THE INVENTION

An object of this invention is to provide a fuze for a projectile that will not detonate if accidental impact occurs before a selected time after launching.

A further object of this invention is to provide a fuze for a projectile that has its point detonation circuit armed at the time that its controlled variable time detonation circuit is armed.

Another object of this invention is to provide the above mentioned functions to a CVTD fuze which also has the PD function so as not to preclude the capability of selecting the PD mode as the exclusive mode of operation.

Other objects, advantages and novel features of the invention will become apparent from the following detailed description of the invention when considered in connunction with the accompanying drawings.

BRIEF DESCRIPTION OF THE DRAWINGS

The FIGURE schematically illustrates the general circuitry and component arrangement of the invention.

DESCRIPTION OF THE PREFERRED EMBODIMENT

Referring to the FIGURE, a possible arrangement of components to accomplish the function of synchronize arming is schematically illustrated. The invention is driven by a power source 11 which is connected by way of isolation and charging resistor 12 to electronic switch 14, CVTD arming switch 16, PD switch 21, and firing capacitor 22. Prior to launch, assuming the CVTD mode of operation is chosen, the time of arming is set. Actuation of the power source at launch causes electronic switch 14 to be primed in such a manner that it is responsive to reception of a target proximity signal on element 15 to change to a closed state. Electronic switch 14 is shown to be a thyratron. However, any vacuum type or solid state active switch element may be used to accomplish the same function.

The mode of operation, along with arming time, is selected prior to launching of the projectile. The CVTD or PD mode is selected by adjusting commutator 17. Commutator 17 consists of conductive commutator segment 18 and insulated segment 19 completing a ring structure upon which a wiper 20 rides. The mode of operation of the fuze circuit is chosen by rotating commutator ring 17 so that wiper 20 rests on the conductive portion 18, or the insulated segment 19. When wiper 20 rests upon the conductive segment 18, of the commutator the fuze will operate in the controlled variable time detonation mode. If the wiper rests on insulated segment 19, the fuze circuit will operate in a PD mode. As can be seen from the drawing, when wiper 20 rests on segment 18, a closed circuit condition exists and when it rests on the insulated segment 19 an open circuit condition exists in that part of the fuzing circuit.

Assuming for illustrations sake that the CVTD mode of operation has been chosen, wiper 20 then rests on segment 18 and presents a closed circuit condition. CVTD arming time is also set at this time so that CVTD arming switch 16 opens after lapse of the time set. The arming time is set manually. Apparatus for determining the lapse of the set time and for moving CVTD arming switch 16 into an open state after such lapse is well known in the art. It is not seen as necessary to describe such apparatus. PD switch 21 is normally in an open state and closes when impact of the projectile with a target occurs. The circuit 10 thus being in a CVTD arming mode, firing capacitor 22 will not charge to a level which can detonate electric primer 23 until the lapse of arming time occurs, causing CVTD arming switch 16 to open. This will, of course, only occur when the projectile is in proximity with the target, or at the earliest, on latter part of its trajectory. If after arming switch 16 opens a target proximity signal is received by electronic switch 14, element 15 of the switch will cause it to become conductive so that firing capacitor 22 will discharge through electric primer 23 causing it to detonate. If no target proximity signal is received and the projectile impacts with a target, PD switch 21 will close causing firing capacitor 22 to discharge through electric primer 23, causing it to detonate.

Assuming now that prior to launch the mode of operation chosen for the fuze circuit 10 is a PD mode. By adjusting commutator 17 so that wiper 20 rests on insulated segment 19, it can be seen from the drawing that firing capacitor 22 will charge immediately upon launch. Upon selection of the PD mode of operation electronic switch 14 will be inactivated by shorting element 15 to ground or some other equally effective measure which is well known and presently used in CVTD fuzes. Therefore, movement of commutator 17 so that wiper 20 rests on insulated segment 19 will cause firing capacitor 22 to charge immediately and further will cause inactivation of electronic switch 14 by present state of the art apparatus, which is not shown, so that the fuzing circuit will not activate the explosives within the projectile until actual impact with target occurs. As can be seen from the FIGURE, upon impact, PD switch 21 will close and firing capacitor 22 will discharge through electric primer 23 causing detonation of the projectile.

Obviously many modifications and variations of the present invention are possible in the light of the above teachings.

What is claimed is:

1. In a projectile fuze, a PD and CVTD arming circuit comprising:

a power source; and an electronic switch connected to and primed by said power source, responsive to a target proximity signal to change its state; and a CVTD arming switch connected to said electronic switch and said power source so that said power source and said electronic switch are ineffectual until said CVTD arming switch is actuated; and a PD or CVTD mode selection means connected to said CVTD arming switch so as to determine the mode of operation of the fuze; and an electric primer in series with a firing capacitor connected to said power source; and a PD switch connected to said CVTD arming switch and said electronic switch and said electric primer so that actuation of said PD switch will cause detonation of the electric primer only if said mode selection means is in the PD mode, or, if said mode selection means is in the CVTD mode, only if said CVTD arming switch has actuated.

2. The arming circuit of claim 1 wherein said electronic switch is normally in an open state and thereafter changes to a closed state upon receipt of a target proximity signal.

3. The arming circuit of claim 2 wherein said CVTD arming switch is normally in a closed state and changes to an open state upon actuation.

4. The arming circuit of claim 3 wherein said PD switch is normally in an open state and changes to a closed state upon actuation.

5. The arming circuit of claim 4 wherein said mode selecting means comprises a commutator that determines mode of operation by presenting a closed circuit or open circuit condition.

6. The arming circuit of claim 5 wherein said commutator determines a CVTD mode of operation by presenting a closed circuit condition and a PD mode of operation by presenting an open circuit condition.

7. The arming circuit of claim 1 wherein said mode selection means comprises a commutator that determines CVTD mode of operation by presenting a closed circuit condition and a PD mode of operation by presenting an open circuit condition.

8. The arming circuit of claim 7 wherein said CVTD arming switch is normally in a closed state and changes to an open state when actuated.

9. The arming circuit of claim 8 wherein said PD switch is normally in an open state and changes to a closed state when actuated.

10. The firing circuit of claim 9 wherein said electronic switch is normally in an open state and changes to a closed state upon receipt of a target proximity signal, and is connected to said power source by a charging resistor and is further connected to said electric primer and the firing capacitor in a manner that will permit the immediate charging of the firing capacitor if said mode selection means is in the PD mode.

* * * * *